US005350218A

United States Patent [19]

Perkins

[11] Patent Number: 5,350,218

[45] Date of Patent: Sep. 27, 1994

[54] KNOCKDOWN FURNITURE STRUCTURE

[76] Inventor: Julian B. Perkins, 2098 Hope Dr., Greenville, N.C. 27858

[21] Appl. No.: 132,452

[22] Filed: Oct. 6, 1993

[51] Int. Cl.[5] ..... A47C 7/02

[52] U.S. Cl. ..... 297/440.1; 297/445; 297/272

[58] Field of Search ..... 297/440.1, 440.14, 440.16, 297/440.2, 440.22, 440.23, 272, 258, 449, 445, 440.15, 440.21, 451, 118, 133

[56] References Cited

U.S. PATENT DOCUMENTS

| | | | |
|---|---|---|---|
| 56,718 | 7/1866 | Coomes | 297/258 X |
| 458,808 | 9/1891 | Judd | 297/440.22 X |
| 655,488 | 8/1900 | Hayes | 297/440.16 X |
| 693,197 | 2/1902 | White | 297/440.20 X |
| 1,257,389 | 2/1918 | Platt | 297/258 X |
| 1,412,197 | 4/1922 | Rehe | 297/445 |
| 2,755,846 | 7/1956 | Shepherdson | 297/440.21 |
| 3,115,367 | 12/1963 | Gariepy | 297/440.1 |
| 3,727,981 | 4/1973 | Ostroff et al. | 297/440.15 |
| 4,225,181 | 9/1980 | Lock et al. | 297/272 X |
| 4,300,455 | 11/1981 | Orzati | 297/440.1 X |

FOREIGN PATENT DOCUMENTS

| | | | |
|---|---|---|---|
| 3130885 | 2/1983 | Fed. Rep. of Germany | 297/449 |

*Primary Examiner*—Kenneth J. Dorner
*Assistant Examiner*—Milton Nelson, Jr.
*Attorney, Agent, or Firm*—Gipple & Hale

[57] ABSTRACT

A furniture structure is described in which the component parts of the structure are disassembled to facilitate storage and shipment, Assembly of the unit is facilitated by convenient attachment pins or dowels and complementary slots in the respective components.

5 Claims, 1 Drawing Sheet

KNOCKDOWN FURNITURE STRUCTURE

SUMMARY OF THE INVENTION

The present invention is directed to a furniture structure having several component parts which are quickly and easily disassembled to facilitate shipping and storage. More specifically the present invention is directed to a furniture structure, such as a chair, which is readily disassembled into several component parts having more compact dimensions than the assembled chair itself and which can be readily assembled by simply joining the component parts together with an interlocking attachment means.

BACKGROUND OF THE INVENTION

Because of their necessary configuration, typical items of furniture such as chairs are one of the most awkward and bulky items for shipment. A typical chair for example, occupies a much larger volume for shipping purposes then its size would otherwise seem to require, largely due to the number of projecting surfaces which typify chairs and other such furniture. For example, a typical rocking chair is provided with a relatively high back which extends in one direction and a pair of rockers extending roughly at right angles to the back of the chair, in addition to the actual seating structure and any arms which may be present on the chair. Accordingly, the size of container, or even just the space that is necessary to accommodate such a chair during shipment, is considerable and contributes significantly to the cost and effort of shipping these items.

It is accordingly, an object of the present invention to provide a furniture structure, such as a chair, which can readily be disassembled into several convenient parts in order to significantly minimize the volume required to ship or otherwise transport the furniture structure either by itself or in a container such as a large box.

It is a further object of the present invention to provide a chair structure having attachment means for the various components parts of the structure which provide a convenient, easy to assemble, interlocking system.

Yet a further object of the invention is to provide a system for assembly of the component parts of a furniture structure which is both simple and inexpensive and does not diminish the strength of the assembled unit.

DETAILED DESCRIPTION OF THE DRAWINGS

DETAILED DESCRIPTION OF THE INVENTION

In accordance with the present invention a furniture structure is provided which essentially consists of a seat which horizontally engages a leg structure consisting of four vertical legs arranged in a quadrangular configuration and mutually interconnected by a plurality of horizontal cross pieces which connect adjacent legs of the leg structure. A rectangular, generally flat back structure, which can have numerous ornamental and other configurations, slidably engages the tops of two of four vertical legs to form the back of the chair. The two vertical legs at the front of the chair extend to a somewhat greater height above the seat of the chair than the two legs at the rear. These two forward legs are provided also with means for connecting with a pair of horizontal arms which extend backward to engage the sides of the back of the chair. Optionally, a pair of rockers, which are slightly curved elongated members, are attached to the bottoms of the legs of the chair.

Of particular significance in the present invention is the manner in which the component elements described above are actually joined together to quickly and easily provide a rigid durable chair structure and to permit disassembly thereof for transport. In the preferred embodiment of the invention, interlocking members are provided which are elongated male members such as dowel rods which slidably engage into complementary slots in the adjacent interlocking furniture structure. Thus, the tops of the four legs of the structure are each provided with a vertical dowel rod or pin which extends upward a short distance to engage complementary slots which are provided in the back structure of the chair and in the arm rests. Additional reinforcement may be provided at particular points of stress such as where the arm rests engage the front posts or legs of the chair.

The invention will however, be more fully appreciated and comprehended by having reference to the drawings which depict a preferred embodiment thereof.

Figure 1:
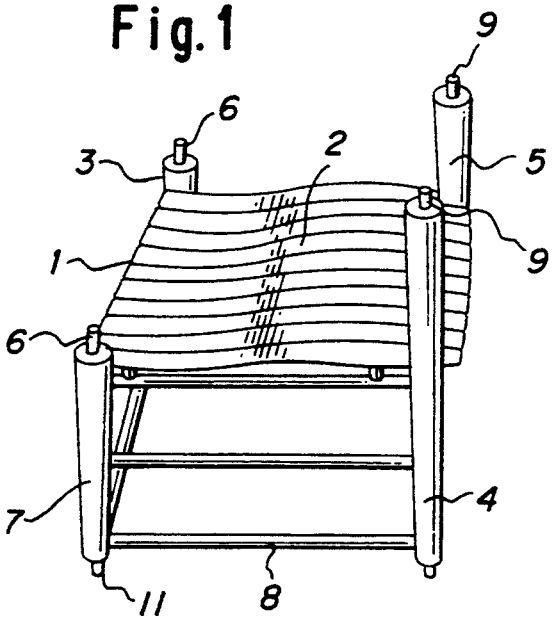
FIG. 1 is a perspective view of the seat structure of a chair in accordance with the present invention.

FIG. 1 of the drawings illustrates the leg and seat structure of the present invention as well as the provision made for attachment of the remaining components of the entire chair. Seat structure 1 is shown consisting of a generally flat seat 2 which, as shown, may be made of slats or any other conventional material commonly used for the seats of chairs and similar structures. The leg structure, which supports the seat 2, consists of two pairs of vertical legs 4, 5, 3, and 7 which are interconnected by a series of horizontal cross pieces 8 connecting adjacent legs to form a square or rectangular array. It will be noted that two adjacent legs 4 and 5, which are at a forward edge of the chair, extend a greater height above the plane of the seat than legs 3 and 7 which are at the rear of the chair. At the upper end of each of the four legs is a pin or dowel which projects upward to engage a complementary slot in the adjoining back and arm structures.

Figure 2:
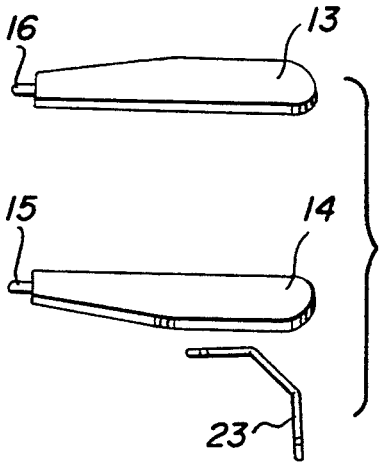
FIG. 2 illustrates the disassembled arms of the chair structure of the invention.
Figure 3:
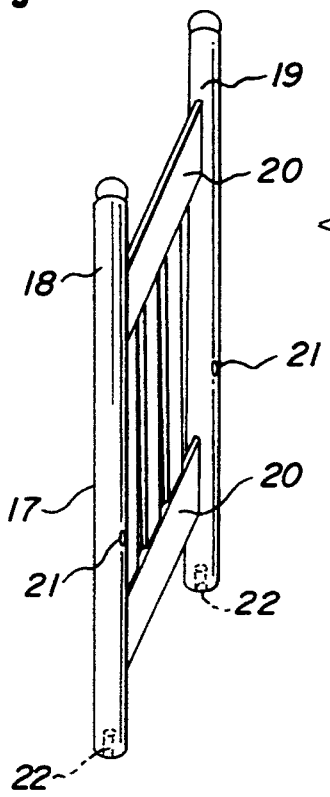
FIG. 3 illustrates the back structure of the chair of the present invention.
Figure 4:
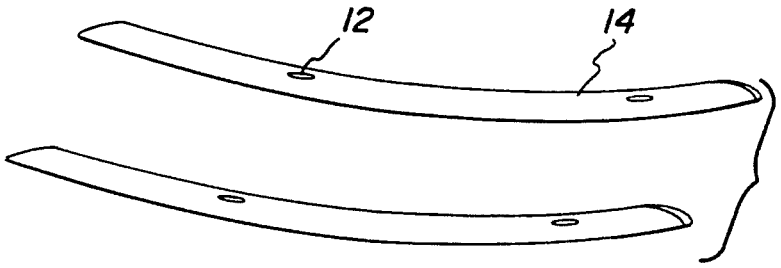
FIG. 4 illustrates the pair of rockers which can be used on the chair of the present invention.

FIG. 3 of the drawings illustrates the back structure of the chair 17 which consists of a pair of spaced vertical posts 18 and 19 connected by two horizontal members 20. It will be appreciated that the actual configuration of the back structure can vary considerably in accordance with design preferences. The lower ends of post 18 and 19 are provided respectfully with vertical slots 22 of appropriate dimensions to accommodate vertical attachment pins 6 in the chair's seat and leg structure, illustrated in FIG. 1 of the drawings. Similar holes or slots are provided in post 18 and 19 at 21 to accommodate horizontal pins 15 and 16 of arm rests 14 and 13, respectively, illustrated in FIG. 2 of the drawings. These am rests are also provided with holes or slots 24 to accommodate the corresponding attachment dowels 9 on legs 4 and 5.

The lower ends of the leg structure may also be provided at 11 with vertical attachment pins or dowels to engage corresponding slots or holes 12 in the pair of rockers 10 that are attached, on assembly, to the bottom of the chair. It will be appreciated however, that the present invention is not restricted in scope to rocking chair structures only.

Figure 5:
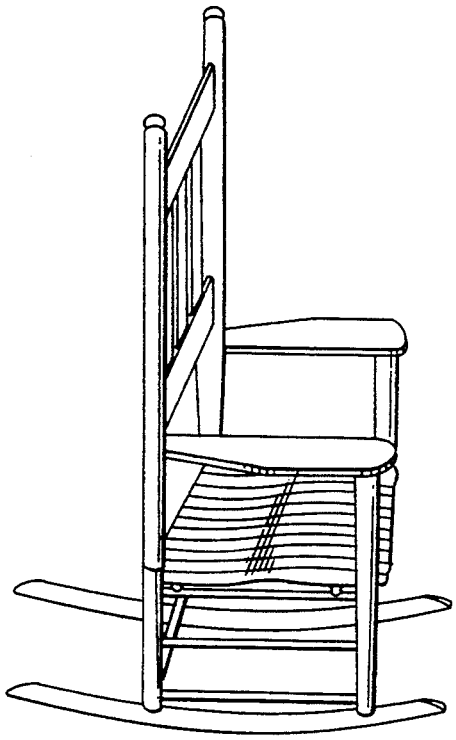
FIG. 5 is a perspective illustration of the assembled chair structure of the invention showing the various components interlocked in place.

As illustrated in FIG. 5 of the drawings, when the leg and seat structure is assembled together with the back, armrest and rockers, an attractive, comfortable and sturdy rocking chair results. As can further be appreciated however, the assembled rocking chair is of such configuration and dimensions as would necessitate an extremely large and awkward container or volume of space for transportation whereas the disassembled components illustrated in FIGS. 1 through 4 of the drawings can easily be transported in a much more compressed volume or container. Assembly of the furniture structure of the invention, requires no particular skills or equipment and can be preformed in a matter of minutes by simply engaging the component parts as illustrated. In the event that a permanent structure is desired rather than one which can be disassembled for future transportation, appropriate adhesives or other binders can be employed to lock the attachment pins into there respective slots.

It will also be appreciated that the illustrated structure of the invention can further be strengthened by the addition of suitable brackets such as those shown in the drawings at 2 3. These brackets attach to the forward legs 4 and 5 of the chair structure at approximately the upper terminus of the legs and engage the underside of the respective arm rests shown in FIG. 2. Attachment to the arm rests is conventionally by means of screws which pass through small holes in the arm brackets.

It will further be appreciated that the present invention, is not limited to the particular chair structure shown by way of illustration herein, but rather encompasses numerous furniture structures which can be provided with the attachment provisions described to facilite disassembly, transportation, and reassembly of the structure. It will further be appreciated that the present invention includes numerous materials which can be employed and other modifications which will be apparent to those of ordinary skill in the art.

I claim:

1. A knockdown furniture structure comprising in combination: a seat horizontally engaging a leg structure comprising four parallel, vertical legs arranged in a quadrangular array and mutually interconnected by a plurality of horizontal cross pieces which connect vertical adjacent legs; one pair of adjacent legs extending to a greater height than the other shorter pair of adjacent legs with the upward, facing ends of said other pair of legs being provided with means for engaging a rectangular back structure which extends vertically above and perpendicular to said seat; said pair of legs of greater height being also provided at their upper ends with means for each to engage a horizontal arm rest which extends back to engage said back structure.

2. The furniture structure of claim 1 wherein said engaging means are elongated members and complementary slots which slidable engage one another.

3. The furniture structure of claim 1 wherein a pair of rocker means is provided for engagement each with the lower ends of an adjacent pair of said legs.

4. The furniture structure of claim 1 wherein said rectangular back structure is defined by a pair of vertical posts joined in spaced, parallel relationship by at least one pair of horizontal, spaced cross pieces.

5. The furniture structure of claim 4 wherein each of said arm rests is provided with an elongated engagement member for engaging a complementary slot in one of said vertical posts.

* * * * *